US008336461B2

(12) United States Patent
Reinmüller

(10) Patent No.: US 8,336,461 B2
(45) Date of Patent: Dec. 25, 2012

(54) HAND GRENADE

(75) Inventor: Arnulf Reinmüller, Österreich (AT)

(73) Assignee: Rheinmetall Waffe Munition Arges GmbH, Österreich (DE)

( * ) Notice: Subject to any disclaimer, the term of this patent is extended or adjusted under 35 U.S.C. 154(b) by 80 days.

(21) Appl. No.: 12/641,045

(22) Filed: Dec. 17, 2009

(65) Prior Publication Data

US 2010/0212532 A1 Aug. 26, 2010

(30) Foreign Application Priority Data

Dec. 18, 2008 (EP) ..... 08022015

(51) Int. Cl.
*F42B 27/00* (2006.01)

(52) U.S. Cl. ..... 102/476; 102/482

(58) Field of Classification Search ..... 102/482–488, 102/475, 476, 492
See application file for complete search history.

(56) References Cited

U.S. PATENT DOCUMENTS

| | | | | |
|---|---|---|---|---|
| 2,094,562 | A * | 9/1937 | Lowy | 102/368 |
| 2,331,198 | A * | 10/1943 | Klang | 102/486 |
| 3,913,483 | A * | 10/1975 | Wolterman | 102/476 |
| 4,444,116 | A * | 4/1984 | Mitard et al. | 102/476 |
| 5,204,493 | A * | 4/1993 | Christmann et al. | 102/307 |
| 6,474,240 | B1 * | 11/2002 | Chemiere et al. | 102/487 |
| 6,595,139 | B1 * | 7/2003 | Haeselich | 102/498 |
| 6,668,727 | B1 * | 12/2003 | Kim et al. | 102/482 |
| 6,761,117 | B1 | 7/2004 | Benz | |
| 7,036,432 | B2 * | 5/2006 | Casenave et al. | 102/492 |

FOREIGN PATENT DOCUMENTS

| | | | |
|---|---|---|---|
| DE | 301 023 | A7 | 9/1992 |
| DE | 199 44486 | C2 | 6/2003 |
| DE | 38 39 064 | C1 | 7/2003 |
| DE | 38 389064 | C1 | 7/2003 |
| DE | 102 59 913 | A1 | 7/2004 |
| DE | 60119505 | T2 | 9/2006 |
| DE | 10 2005 035580 | B3 | 1/2007 |
| DE | 102004 059 991 | B4 | 3/2007 |
| EP | 1 128 155 | B1 | 11/2000 |
| EP | 1 317 650 | B1 | 5/2001 |
| WO | 99/57503 | | 11/1999 |
| WO | 01/63199 | A1 | 8/2001 |

OTHER PUBLICATIONS

Harris, Tom, How Grenades Work, HowStuffWorks.com, Jan. 22, 2002, http://science.howstuffworks.com/grenade.htm (downloaded Jun. 7, 2012).

* cited by examiner

*Primary Examiner* — Bret Hayes
*Assistant Examiner* — Reginald Tillman, Jr.
(74) *Attorney, Agent, or Firm* — Griffin & Szipl, P.C.

(57) ABSTRACT

Building on a modular construction of a hand grenade (10), the invention provides a module (1) that can be integrated in the hand grenade (10) and can be equipped with a hollow charge insert (3) in order to act as an armor-penetrating part. The module (1), including the hollow charge insert (3), can be fixed (mounted, screwed, clipped, etc.) at the bottom end of the hand grenade (10) and is attached to the armored element. In the simplest form, the hand grenade (10) is put down, in the case of side walls possibly hung on, and the hand grenade (10) is attached so that the hollow charge insert (3) can exert an adequate effect on the target medium.

21 Claims, 2 Drawing Sheets

HAND GRENADE

This application claims priority from European Patent Application No. 08 022 015.5, filed Dec. 18, 2008, the entire disclosure of which is incorporated herein by reference.

FIELD OF THE INVENTION

The invention relates to a hand grenade provided with an integratable hollow charge or hollow charge insert.

BACKGROUND OF THE INVENTION

Hand grenades, as the name indicates, are thrown by a soldier in particular for self-defense, wherein a safety lever is detached beforehand and an ignition mechanism triggers the ignition.

A hand grenade is described, for example, in DE 10 2005 035 580 B3. This has an active body containing an active charge and an ignition device for igniting the active charge. The hand grenade itself is characterized in that a code generator is integrated in the ignition device, which code generator with the aid of a random generator generates an ignition code immediately before, or only when, the operating element is detached, which ignition code is stored both in a code memory of the ignition trigger remaining with the operator and in a code memory of the igniter. U.S. Pat. No. 6,761,117 B1 likewise features an ignition device that uses an electronic ignition system in a hand grenade.

Hand-grenade-like objects, such as irritation bodies, are used, e.g., in hostage-taking or aircraft hijackings to support police or military actions. They are likewise ignited manually as a rule and then flung away.

An irritation body with impulse gears is known from DE 102 59 913 B4. The irritation body is shifted into rolling movements by means of the impulse gears.

Other irritation bodies can be taken from DE 199 44 486 C2 or DE 10 2004 059 991 B4. DE 199 44 486 C2 is concerned thereby with the physical structure of the compartments integrated into the container, while DE 10 2004 059 991 B4 relates to the cross-sections of blow-out openings of the compartments.

The object of the invention is to set forth a hand grenade or the like type of construction that has a larger range of application than currently known constructions.

SUMMARY OF THE INVENTION

The object is achieved by the features of a first embodiment of the invention, which pertains to a hand grenade (10) provided with an active body containing an active or primary charge and an ignition device characterized by a module (1) that can be integrated at the bottom end, containing an explosive (2) and a hollow charge insert (3). Further advantageous embodiments are described as follows.

In accordance with a second embodiment of the present invention, the first embodiment is modified so that a projection (4) is provided in the explosive for the shock wave transmission of the primary charge. In accordance with a third embodiment of the present invention, the first embodiment, or the second embodiment, is further modified so that the hollow charge insert (3) is a flat-cone or pointed-cone hollow charge insert. In accordance with a fourth embodiment of the present invention, the first embodiment, or the second embodiment, is further modified so that the hollow charge insert (3) has a ring shape. In accordance with a fifth embodiment of the present invention, the hand grenade of the third embodiment is further modified so that the ring shape features a V- or U-cross section.

In accordance with a six embodiment of the invention, the first embodiment, the second embodiment, the third embodiment, the fourth embodiment, and the fifth embodiment are further modified so that a material, such as copper or crystal glass, can be used as a hollow charge insert (3). In accordance with a seventh embodiment of the present invention, the first embodiment, the second embodiment, the third embodiment, the fourth embodiment, the fifth embodiment, and the sixth embodiment, are further modified so that the hand grenade is placed on a target medium or fixed thereto. In accordance with an eighth embodiment of the present invention, the seventh embodiment is further modified so that an ignition takes place directly, or transmitted by means of a spark, or the like.

Building on a modular construction of the hand grenade, the invention is based on the concept of providing a module that can be integrated in the hand grenade and can be equipped with a hollow charge, in order thus to act as an armor-penetrating part. The module including the hollow charge can be fixed (mounted, screwed, clipped, etc.) at the bottom end of the hand grenade, and may be attached to the armored element. In the simplest form, the hand grenade is put down, in the case of side walls possibly hung on. It is important that the hand grenade is attached so that the hollow charge can exert an adequate effect on the target medium.

It is not excluded and yet rather use-dependent that the hollow charge can be embodied as a flat-cone or pointed-cone hollow charge. These act purely at particular points, and could be integrated when a high penetration depth in the target is desired. However, this effect is often associated with a lower material delivery, relative to the diameter.

In the preferred embodiment, the hollow charge is therefore embodied in ring form with a V- or U-cross section (ring cut charge). This is initiated by a segment of a circle of explosive lying behind it, which in turn is initiated by the primary charge of the hand grenade. Through the initiation on the upper side of the explosive, close to the center of the segment of the circle, an optimal deformation of the insert outer or inner side can be ensured. Due to the ring-shaped hollow charge geometry, the destroyed surface increases in diameter, which may be desired in specific applications. Compared to a pointed-cone or flat-cone hollow charge, reduced penetration depths caused by the design are hereby compensated for.

This simple adaptation of the hollow charge in a hand grenade allows these hand grenades to act against armored targets not purely spatially, as hitherto, but also at particular points.

Various hollow charge inserts in projectiles are already known. Thus, DE 38 39 064 C1 describes a hollow charge projectile with low space requirement, and WO 99/57503 describes an ammunition body with a hollow charge. EP 1 128 155 B1 discloses a wall-smashing warhead. DD 301 023 A7 is also concerned with an armor-piercing hollow charge explosive device with reinforcement charge. Inserts of sintered tungsten for hollow charges can be taken from DE 601 19 505 T2 (EP 1 317 650 B1). WO 01/63199 A1 also shows a warhead, here with a ring-shaped hollow charge.

The invention is to be described in more detail based on a simplified exemplary embodiment with drawing.

BRIEF DESCRIPTION OF THE DRAWINGS

They show.

DETAILED DESCRIPTION OF THE INVENTION

Figure 1:
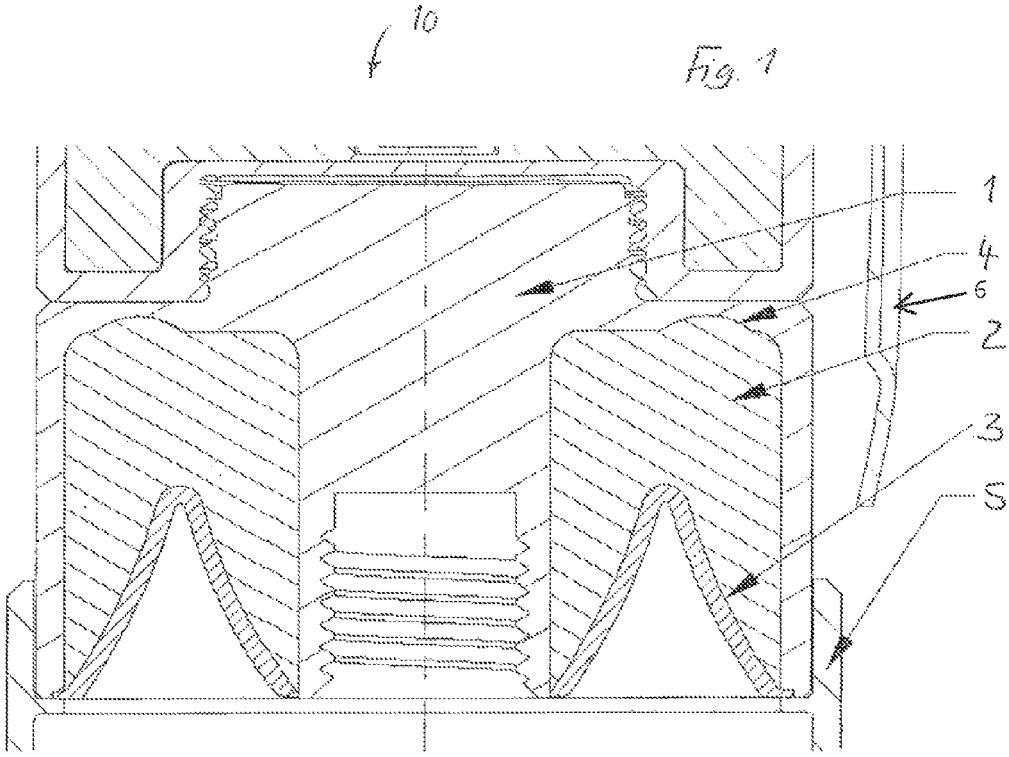
FIG. 1 illustrates a hand grenade module with a hollow charge in a sectional representation.

In FIG. 1, a hand grenade or a hand grenade-like object that preferably has a modular construction, is labeled 10. The modular body 1 contains an explosive 2 and, in a non-limiting embodiment, a ring hollow charge insert 3. A projection in the explosive is labeled "4." A cover plate 5 covering this module 1 serves as a cover cap and can serve for attachment to the target medium. A safety lever 6, partly shown, can be seen as part of an ignition device 11 of the hand grenade 10.

The shock wave transmission of the primary charge (not shown in more detail) of the hand grenade to the explosive segment of a circle 3 (to the hollow charge insert) is implemented by the projection 4 in the explosive 2. Initiated by this, the explosive 2 deforms the insert 3 and thereby forms the liner.

Figure 2:
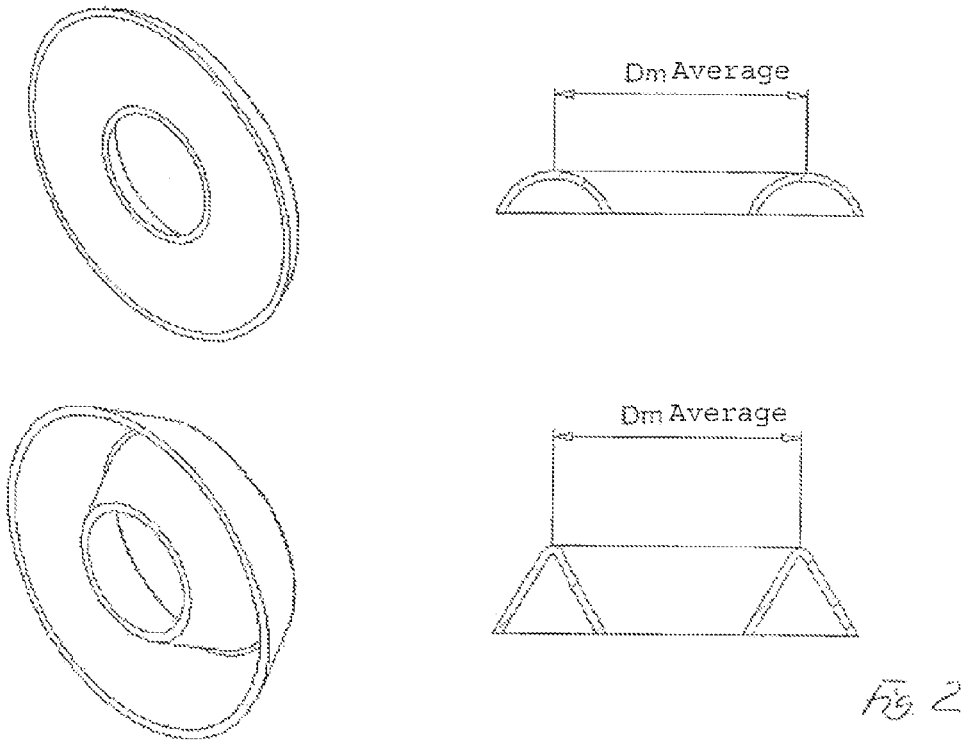
FIG. 2 shows shapes of the hollow charge from FIG. 1.
Figure 3:
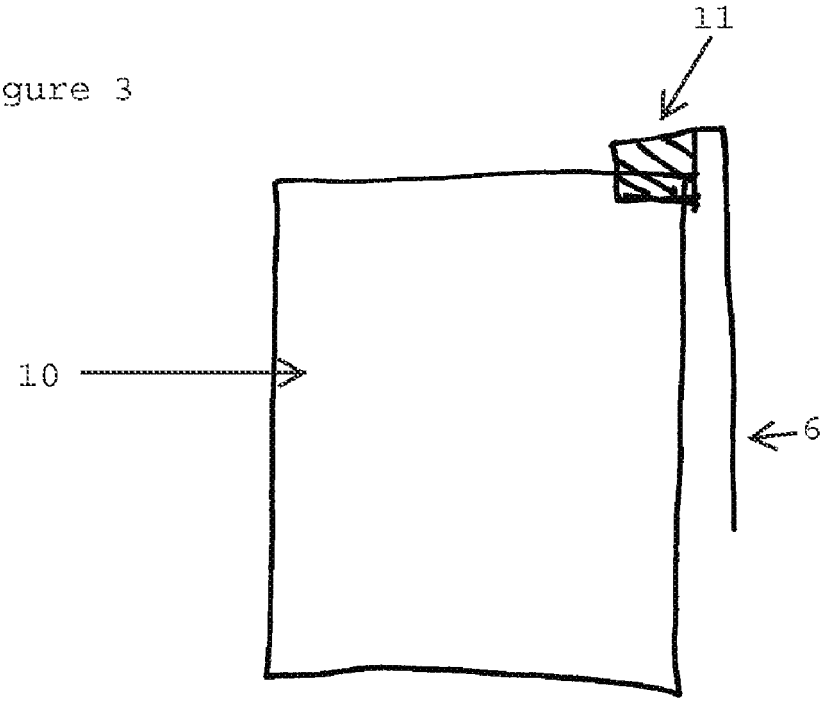
FIG. 3 illustrates a hand grenade module with an ignition device.

Examples of cross sections of a ring hollow charge are shown in FIG. 2. Copper is used as a hollow charge material, likewise crystal glass, etc. The hand grenade 10 is placed on a target medium, for example, and ignited directly or by means of signal transmission.

The invention claimed is:

1. A hand grenade comprising:

(a) an active body containing an active or primary charge;

(b) an ignition device; and (c) a separate module integrated at a bottom end of the hand grenade, wherein the module contains (i) a circular ring of explosive, wherein the circular ring of explosive is ignited by a shockwave of the active or primary charge; and (ii) a ring shaped hollow charge insert, wherein the ring shaped hollow charge insert and the circle of explosive are coaxial.

2. A hand grenade according to claim 1, wherein the circular ring of explosive comprises a projection disposed to transmit the shock wave of the active or primary charge.

3. A hand grenade according to claim 1, wherein the ring shaped hollow charge insert includes a material selected from the group consisting of copper and crystal glass.

4. A hand grenade according to claim 1, wherein the hand grenade is placed on a target medium or fixed thereto.

5. A hand grenade according to claim 4, wherein ignition of the hand grenade takes place directly or is transmitted by means of a spark.

6. A hand grenade according to claim 1, wherein the ring shaped hollow charge insert features a V-cross section or a U-cross section.

7. A hand grenade according to claim 2, wherein the ring shaped hollow charge insert includes a material selected from the group consisting of copper and crystal glass.

8. A hand grenade according to claim 6, wherein the hollow charge insert includes a material selected from the group consisting of copper and crystal glass.

9. A hand grenade comprising:

(a) an active body containing an active or primary charge;

(b) an ignition device; and (c) a separate module integrated at a bottom end of the hand grenade, wherein the module contains i. a circular ring of explosive, wherein the circular ring of explosive is ignited by a shockwave of the active or primary charge; and ii. a ring shaped hollow charge insert, wherein the ring shaped hollow charge insert and the circle of explosive are coaxial, and wherein the module is integrated by clipping the module to the bottom end of the hand grenade.

10. A hand grenade according to claim 9, wherein the ring shaped hollow charge insert features a V-cross section or a U-cross section.

11. A hand grenade according to claim 9, wherein the hollow charge insert includes a material selected from the group consisting of copper and crystal glass.

12. A hand grenade according to claim 10, wherein the hollow charge insert includes a material selected from the group consisting of copper and crystal glass.

13. A hand grenade according to claim 9, wherein the circular ring of explosive comprises a projection disposed to transmit the shock wave of the active or primary charge.

14. A hand grenade according to claim 9, wherein the hand grenade is placed on a target medium or fixed thereto.

15. A hand grenade according to claim 9, wherein ignition of the hand grenade takes place directly or is transmitted by means of a spark.

16. A hand grenade comprising:

(a) an active body containing an active or primary charge;

(b) an ignition device; and (c) a separate module integrated at the bottom end of the hand grenade, wherein the module contains i. a circular ring of explosive, wherein the circular ring of explosive is ignited by a shockwave of the active or primary charge; and ii. a ring shaped hollow charge insert, wherein the ring shaped hollow charge insert and the circle of explosive are coaxial, and wherein the module is integrated by screwing the module to the bottom end of the hand grenade.

17. A hand grenade according to claim 16, wherein the hollow charge insert includes a material selected from the group consisting of copper and crystal glass.

18. A hand grenade according to claim 16, wherein the ring shaped hollow charge insert features a V-cross section or a U-cross section.

19. A hand grenade according to claim 16, wherein the circular ring of explosive comprises a projection disposed to transmit the shock wave of the active or primary charge.

20. A hand grenade according to claim 16, wherein the hand grenade is placed on a target medium or fixed thereto.

21. A hand grenade according to claim 16, wherein ignition of the hand grenade takes place directly or is transmitted by means of a spark.

* * * * *